US009399934B2

(12) United States Patent
Barber et al.

(10) Patent No.: US 9,399,934 B2
(45) Date of Patent: Jul. 26, 2016

(54) UAV ENGINE LUBRICATION SYSTEM INCORPORATING AN ELECTRIC OIL PUMP AND LUBRICATION OIL HEATING CAPABILITY

(71) Applicant: ORBITAL AUSTRALIA PTY LTD, Western Australia (AU)

(72) Inventors: Terran Ambrose Barber, Mount Hawthorn (AU); John Howard Tubb, Bedfordale (AU); Geoffrey Paul Cathcart, Mount Lawley (AU); Robert Walter Frew, Scarborough (AU); Donald Andrew Railton, Duncraig (AU)

(73) Assignee: Orbital Australia Pty Ltd, Balcatta (AU)

( * ) Notice: Subject to any disclaimer, the term of this patent is extended or adjusted under 35 U.S.C. 154(b) by 66 days.

(21) Appl. No.: 14/406,507

(22) PCT Filed: Jun. 7, 2013

(86) PCT No.: PCT/AU2013/000605

§ 371 (c)(1),
(2) Date: Dec. 8, 2014

(87) PCT Pub. No.: WO2013/181709

PCT Pub. Date: Dec. 12, 2013

(65) Prior Publication Data

US 2015/0152757 A1 Jun. 4, 2015

(30) Foreign Application Priority Data

Jun. 8, 2012 (AU) ..... 2012902417

(51) Int. Cl.

| | |
|---|---|
| ***F01M 5/00*** | (2006.01) |
| ***F01M 1/02*** | (2006.01) |
| ***F01M 1/16*** | (2006.01) |

(52) U.S. Cl.
CPC . *F01M 1/02* (2013.01); *F01M 1/16* (2013.01); *F01M 5/001* (2013.01); *F01M 2001/0215* (2013.01)

(58) Field of Classification Search
CPC ..... F01M 1/02; F01M 1/16; F01M 5/001; F01M 5/005; F01M 5/02; F01M 5/021; F01M 2001/0215
USPC ..... 123/196 AB
See application file for complete search history.

(56) References Cited

U.S. PATENT DOCUMENTS

| | | | | |
|---|---|---|---|---|
| 7,451,753 | B2 * | 11/2008 | Bell | F02C 7/224 123/196 R |
| 8,459,392 | B2 * | 6/2013 | Bernier | B62M 27/02 123/196 R |
| 2007/0246302 | A1 | 10/2007 | Bel | |
| 2010/0163327 | A1 | 7/2010 | Bernier | |

* cited by examiner

*Primary Examiner* — Hai Huynh
(74) *Attorney, Agent, or Firm* — Charles H Jew

(57) ABSTRACT

An unmanned aerial vehicle (UAV) engine (40) lubrication system and lubrication oil heating strategy uses a solenoid actuated electric oil pump (10,42) to deliver lubrication oil to the engine from a lubrication oil reservoir (12,44) by energizing and de-energizing the solenoid (18) to operate a pump mechanism of the electric oil pump. A controller (ECU) (100) can control operation of the electric oil pump, the solenoid maintained energized for a required period of time to cause heating of the oil without continuously pumping the oil. An electric oil pump control strategy can maintain engine speed dependent minimum oil delivery rates, can heat the electric oil pump and oil through extended energized (ON) time of the solenoid, and, by varying the turn on time of the electronic oil pump based on sensed ambient temperature, long time periods can be used to ensure oil delivery for cold temperatures, and shorter times are permitted when necessary in order to reach maximum oil flow rate.

23 Claims, 4 Drawing Sheets

UAV ENGINE LUBRICATION SYSTEM INCORPORATING AN ELECTRIC OIL PUMP AND LUBRICATION OIL HEATING CAPABILITY

FIELD OF THE INVENTION

The present invention relates to electrically controlled oil lubrication via an electric oil pump in engines of unmanned aerial vehicles (UAVs).

The present invention is particularly applicable to two stroke UAV engines, and more particularly to two stroke single and dual fluid direct injection UAV engines, preferably those engines using heavy fuel.

BACKGROUND TO THE INVENTION

Overall weight, fuel capacity, fuel economy, lubrication oil capacity and lubrication oil economy are all important factors for achieving range (distance) and duration (flight time) in the air for a UAV. Range and duration are related in that the longer a UAV can remain in the air the further range it may have. Duration also means that a UAV can remain over a location as long as possible, which need not be at the longest range from its take off and landing point.

Oil consumption is very important for UAV applications as it is directly linked to the vehicle's available range and duration. Engines with low oil consumption have the advantage of greater range and duration for a given initial mass of oil. It is not preferable to simply increase the amount of oil because this adds to the weight of the UAV. Improved oil economy is preferred for the reasons given above.

Two stroke engines often combust a pre-mix of oil and fuel. The pre-mix comprises a proportion of oil to maintain lubrication in the cylinder, and the fuel for power. However, it is understood that pre-mixed oil and fuel does not work for direct injection engines. The injection system cannot efficiently inject the lubrication oil and fuel pre-mix to achieve an acceptable combustion and fuel economy as well as provide lubrication to the engine components.

Other strategies for lubricating the two stroke UAV engine have been devised. A mechanical oil pump can be driven from the crankshaft. However, oil delivery is tied to engine speed. The faster the engine speed, the faster the pump operates, though giving the same volume of oil per pump stroke. Thus, the mechanically driven pump may under deliver or over deliver lubrication oil for a given engine speed. Under delivery of oil results in insufficient engine lubrication which causes poor engine reliability and durability. Over delivery causes poor oil economy because more oil than necessary is delivered for lubrication purposes, and the UAV engine will have poor oil consumption and hence reduced UAV range or duration.

The actual lubricant requirements of a UAV engine are also a function of the altitude at which the UAV operates, the engine temperature, and the engine speed or load demand (represented by position of the throttle, or a direct command from the operator). Very high altitude capability is a key differentiator between UAV engines and other engines with oil pumps.

Since UAVs are often operated at very high altitudes or in regions where wind chill creates extremely low temperatures, and also in regions where temperatures can vary greatly in winter even at ground level (which itself may be at a relatively high altitude), the actual lubricant requirements of the engine can be significantly affected by these factors and therefore need to be taken into account.

Conventional UAV lubrication systems using mechanical oil pumps or 2 stroke pre-mix, due to the linear relationship between the engine speed and the amount of lubricant being pumped, cannot take all of these into account.

For a two-stroke UAV engine, the actual lubricant requirement depends, at least in part, on the power output of the engine, not engine speed. The higher the power output, the more lubricant is required. There are instances during the operation of the two-stroke engine where the engine speed is high, but where the power output of the engine is low. In such instances, a mechanical oil pump driven by the engine would provide a lot of lubricant even though the actual requirements are low.

There are other instances where the actual lubricant requirements are lower than what would be provided by a mechanical oil pump driven by the engine. For example, at start-up, all of the lubricant that was present in the engine when it was stopped has accumulated at the bottom of the crankcase. The accumulated lubricant would be sufficient to lubricate the engine for the first few minutes of operation; however a mechanical oil pump, due to its connection to the engine, would add lubricant regardless.

Therefore, in the case of a two-stoke engine, using a mechanical oil pump results in more lubricant being consumed by the engine than is actually required under such operating conditions. This also results in a level of exhaust emissions that is higher than a level of exhaust emissions that would result from supplying the engine with its actual lubricant requirements since more lubricant gets combusted than is necessary.

Low viscosity of oil for lubrication is another factor relevant to certain engines which are required to operate in environments with cold ambient conditions as this can lead to problems with delivery of the oil to the engine at certain times. Preheating of lubrication oil is one know method for helping to alleviate this problem and one known example of preheating lubrication oil is disclosed in published patent application US 20070246302. An electric motor is used to preheat the oil. The rotor of the electric motor is either locked to cause heating or the rotor is spun without the pump operating in order to generate heat. In the former case, an additional locking mechanism is required to ensure that the rotor does not spin and otherwise cause oil to be pumped. In the latter case, the rotor and pump mechanism require an additional disengagement mechanism to prevent the spinning rotor from operating the pump and pumping oil. In either scenario, there is an inherent real risk of the additional (locking or disengagement) mechanisms failing and preventing the pump from operating as a lubrication pump or not being able to act as a heating source. The present invention avoids such problems.

Furthermore, US 20070246302 is generally directed to overcoming cold, viscous oil in a reservoir during cold start-up of gas turbine aircraft engines. Once started and warm, the pump motor form of heating is not required.

Still further, gas turbine engines of the type discussed in US 20070246302 typically have considerable waste heat associated with their normal running operation. Hence, there is typically sufficient heat during normal running to maintain the temperature of the lubricating oil to prevent the oil thickening below accepted limits.

Thus, US 20070246302 is directed to heating the oil during turbine start-up but not once the engine is running. The present invention is directed to heating oil for lubricating two stroke and four stroke fuel injected UAV internal combustion (piston) engines. Such engines operate in extreme conditions, running at much lower revolutions than gas turbine engines and therefore not generating such high levels of heat once running. An electric solenoid actuated lubrication oil pump of the present invention can operate according to a control strategy to provide additional heat to the lubrication oil at start-up and during engine running. This is particularly beneficial for high altitude or long duration running in cold climates.

With the aforementioned in mind, it would also be beneficial to provide improved control of lubrication oil supply for increased range and duration of UAVs, particularly 2 stroke UAV engines utilising direct injection and/or for an air compressor of a dual fluid (air assisted) direct injection engine.

More particularly, it is desirable to provide a lubrication system that provides an amount of lubricant that is at or near the actual lubricant requirements of the UAV engine for given conditions.

SUMMARY OF THE INVENTION

With the aforementioned in mind, the present invention, in one aspect, provides an unmanned aerial vehicle (UAV) engine lubrication system including an electric oil pump to deliver lubrication oil to the engine.

A further aspect of the present invention provides an unmanned aerial vehicle (UAV) engine lubrication system including a solenoid actuated electric oil pump to deliver lubrication oil to the engine from a lubrication oil reservoir by energising and de-energising the solenoid to operate a pump mechanism of the electric oil pump, and a controller to control operation of the electric oil pump, the solenoid maintained energised for a required period of time to cause heating of the oil without continuously pumping the oil.

The electric oil pump is understood to be fluidly connected to the engine for delivering lubricant to the engine. The electric oil pump may be internally or externally mounted with respect to the engine.

The controller may be arranged and configured to vary the energisation period of the solenoid to effect a lubrication oil heating strategy. Thus, the solenoid actuated electric oil pump for the UAV engine can be controlled with a variable energisation ('on') period control strategy where cony refers to the solenoid being energised, and 'off' refers to the solenoid being de-energised.

The solenoid of the electric oil pump may be controlled with a variable energised ('on') period control strategy dependent on engine speed and temperature. Temperature may be engine temperature, exhaust temperature or oil temperature, or a combination of one or more thereof.

It will be appreciated that, at cold temperatures (e.g. <10° C.) a UAV engine using a relatively small and/or lightweight oil pump will have oil delivery issues at low oil flow rates (i.e. when there is low oil pump actuation frequency). It has been realised that increasing the solenoid energisation period ('on' time), particularly at low frequency operation (e.g. <1 Hz), can help to alleviate such oil delivery issues.

At higher oil flow rates when the electric oil pump is energised more often to deliver the required amount of oil to the engine, the increased energisation period ('on' time) will exceed the maximum permissible on time. Thus, it is beneficial to vary the period of energisation with engine speed, otherwise an oil flow turn down ratio required from the oil pump may not be achieved.

An electronic control unit (ECU) (such as an engine management system) may be electrically connected to the electronic oil pump for controlling actuation of the electric oil pump.

An engine speed sensor may be electrically connected to the ECU for transmitting a signal representative of engine speed to the ECU.

Engine load may be sensed or determined (such as through a throttle position sensor, or other input including CAN message). Altitude may also be sensed or determined. One or more of these may be used as a parameter to control the electric pump.

The ECU may control the actuation of the electric oil pump based at least in part on a signal representative of engine speed.

The electric oil pump may be provided external to an oil supply reservoir, such as an oil tank.

The electric oil pump may be connected to a bottom of the oil reservoir to receive an oil feed from an outlet adjacent or at a bottom of the reservoir. In at least one embodiment the electric oil pump is provided within the oil reservoir.

The electric oil pump may be submergible within the oil in the reservoir and remain operational i.e. be operatively oil submersion proof.

The engine may have multiple combustion chambers or cylinders. The electronic oil pump therefore may include multiple first outlets. Each one of the first outlets fluidly communicates with a corresponding one of the combustion chambers or cylinders.

The UAV oil lubrication system may include at least one heat generating component. The electric oil pump may be disposed in proximity to the at least one heat generating component. Alternatively, the heat generating component may be within the pump. For example, the electric pump may have a coil energised by supply of electricity. Energisation of that coil may effect movement of a core. Over energisation, such as supply of current over a required amount to move the core can be used to generate heat to heat the pump and/or lubricating oil. This beneficially can help to prevent freezing of the pump in low temperature conditions or thickening of the oil and poor oil delivery to the engine. Air temperature, as measured by a sensor which supplies a signal to the ECU, could be used to determine the amount of warming (length of electrical pulse to oil pump) required.

The at least one heat generating component may alternatively or in addition include at least one of: an exhaust conduit fluidly communicating with an exhaust port of the engine, a coolant hose fluidly communicating with a cooling system of the engine, and a heat exchanger fluidly communicating with a cooling system of the engine.

The electric oil pump may be disposed adjacent an exhaust of the engine, the coolant hose, or the heat exchanger.

The electric oil pump may include an electromagnetic coil. Thus, the solenoid may be termed an electromagnetic coil.

Another aspect of the present invention may provide a method of pre-heating lubrication oil for supply to an engine of an unmanned aerial vehicle (UAV), the method including energising a solenoid associated with an electric oil pump with an electrical current for a required period of time.

The period that the solenoid is energised may be varied dependent upon engine speed or temperature, or both engine speed and temperature. A slower engine speed may be used to determine a relatively long solenoid energisation period whilst keeping the electric pump within its operating parameters to prevent the pump overheating. As the engine speed increases, and the duty cycle rate of the pump increases, the solenoid energisation period for heating the oil may be reduced in order to prevent overheating of the pump. Thus, the energisation period can be varied dependent upon engine speed conditions. Such control can be effected by the ECU.

Temperature can also be used as a variable to determine the energisation period. Temperature can be sensed as ambient temperature, engine temperature, oil temperature or pump temperature, or any combination of two or more such temperatures. The ECU can utilise such sensed temperature(s) to determine the required energisation period.

It will be appreciated that the energisation period is determined either as a time period over and above the normal energised duty time to effect a pump stroke or can be determined as the total energised period for a duty pump cycle including additional time over and above the normal duty pump stroke. Essentially, the solenoid is maintained energised for a period of time sufficient to effect heating of the oil prior to delivery of the oil to the engine. This strategy can be effected at start-up and during running of the engine. Thus, even with the engine running, and the pump periodically delivering lubrication oil as required, the energised period of the solenoid can be extended over and above a normal duty pump stroke period to effect heating of the oil.

The energised period can extend a duty energised period of the solenoid during a pumping stroke of the pump. Furthermore, control of the solenoid can be effected for pre-heating or normal duty cycle, or both pre-heating and normal duty cycle via an ECU.

A further aspect of the present invention provides a method of operating an electric oil pump of an oil lubrication system of a UAV engine, the pump including a solenoid (an electromagnetic coil), the method including determining a cycle time of the electronic oil pump; determining a first time period being longer than a stroke time of the pump; connecting the electromagnetic coil to an electrical supply for the first time period; and disconnecting the electromagnetic coil from the electrical supply for a remainder of the cycle time.

The first time period may be less than or equal to the pump cycle time less a return time of the electronic oil pump. The first time period may be between 30 and 50 percent of the cycle time. In an additional embodiment, the first time period may be about 40 percent of the cycle time.

Preferably the first time period is a constant regardless of the cycle time.

Connecting the electromagnetic coil to the power source for the first time period may be used to supply heat to a lubricant (oil) in the electric oil pump.

The method may further include sensing an engine speed of an engine to which the electric oil pump supplies lubricant.

The first time period is a constant when the engine speed is less than a predetermined engine speed regardless of the cycle time.

In an additional aspect, the predetermined engine speed is an idle speed of the engine.

One or more forms of the present invention may include sensing an ambient air temperature, reducing an engine speed limit of an engine to which the electric oil pump supplies lubricant when the ambient air temperature is below a predetermined temperature, and determining the cycle time of the electric oil pump including sensing an engine speed of the engine.

Determining the cycle time of the electric oil pump may include sensing one or more of throttle position, ambient air pressure or coolant temperature.

Determining the cycle time of the electric oil pump may include determining if the engine is in a running in or warm up period.

Determining the cycle time of the electric oil pump may include looking up data associated with the electric oil pump.

The electric oil pump advantageously allows for oil flow rate to be controlled independently of engine speed and load. The electric oil pump is more controllable for improved delivery of lubricating oil within the engine.

Unlike mechanically driven oil pumps, or pre-mix oil delivery for 2 stroke engines, where the amount of lubricating oil delivered is determined solely by engine speed or load, an electric fuel pump can be controlled to deliver oil at a faster or slower rate to meet required oil delivery demanded by the engine given the ambient conditions, load on the engine, type of fuel used or fuel air mixture which can each affect engine temperature and lubrication needs.

Independent oil pump control allows for the oil flow rate to be optimised which improves oil consumption. For example it is possible to deliver oil in proportion to engine load and or speed instead of engine speed alone.

In addition, the use of an electric oil pump with fixed oil delivery per actuation allows the Engine Management System to count the number of pump actuations and use the count to report and record accumulated oil consumption and/or oil volume remaining in the oil tank. This feature allows accurate oil consumption data to be communicated to the operator of the UAV. The UAV operator is now able to make decisions on duration (flight time), distance, speed (equates to fuel and oil consumption) and flight profile based on more accurate information.

In addition, spark ignited heavy fuel engines can develop large amounts of carbon build up in areas not limited to the combustion chamber, the piston ring, and the exhaust ports. This is due to the comparatively poor combustion quality of the heavy fuel when burnt in a spark ignited (nominally gasoline fuelled) engine. The carbon must be treated and removed during engine operation in order to prevent degraded engine performance and eventual failure. This is handled through specific formulations of 2 stroke engine oil. These formulations contain detergents and other additives which act to clean the carbon build up from the engine. The oil must be delivered to both areas requiring lubrication and those requiring carbon build up removing. Some areas such as the piston ring require the oil for both reasons. The use of an electric oil pump allows for specific targeting of the oil delivery to the areas of highest need, or from which the oil will be distributed further mechanically.

Furthermore, the electric oil pump addresses the inability of a direct injected engine to deliver pre-mix (oil mixed into the fuel supply) to the crankcase of the engine. Direct injection involves fuelling directly into the combustion chamber, so pre-mix fuel and oil is unable to be used because it would not to reach the necessary locations as it would if the fuel system was port injected or crankcase injected, or used a carburetor. Scavenging lubrication oil from the crankcase is not possible with direct injection. Crankshaft bearings, con rod bearing, piston rings and cylinder wall are all locations that would suffer oil starvation. Instead, in a direct injection engine the oil is delivered separately to the fuel using the electronic oil pump. Attempting to inject oil through a delivery injector directly in to the combustion chamber may also introduce other undesirable effects in terms of injector operation and poor engine exhaust emissions due to oil being combusted in the combustion chamber together with the requisite air-fuel charge.

In addition, the UAV engine is required to operate in environments with cold ambient temperatures, such as at high altitudes. At temperatures of −10° C. and lower, the viscosity of the oil can result in limited flow through the oil delivery system. Having electronic control of the pump allows the pump to be actuated differently for colder ambient conditions.

Advantages of an electrically driven oil pump in a UAV engine include, but are not limited to, the following:

- improved UAV range through improved oil consumption;
- improved engine durability through carbon deposit cleaning and accurate lubrication;
- reliable metering of oil delivery, including the ability, via a controller or engine management system, to report consumption to an operator;
- controllable metering of oil delivery; and
- warm-up strategies providing compensation for cold oil conditions.

DESCRIPTION OF PREFERRED EMBODIMENT

According to one or more preferred embodiments of the present invention, the electric oil pump 10 is in fluid connection with a reservoir of oil (tank or bottle) 12. The reservoir provides a supply of oil from its outlet 14 to an inlet 16 of the pump.

Figure 1:
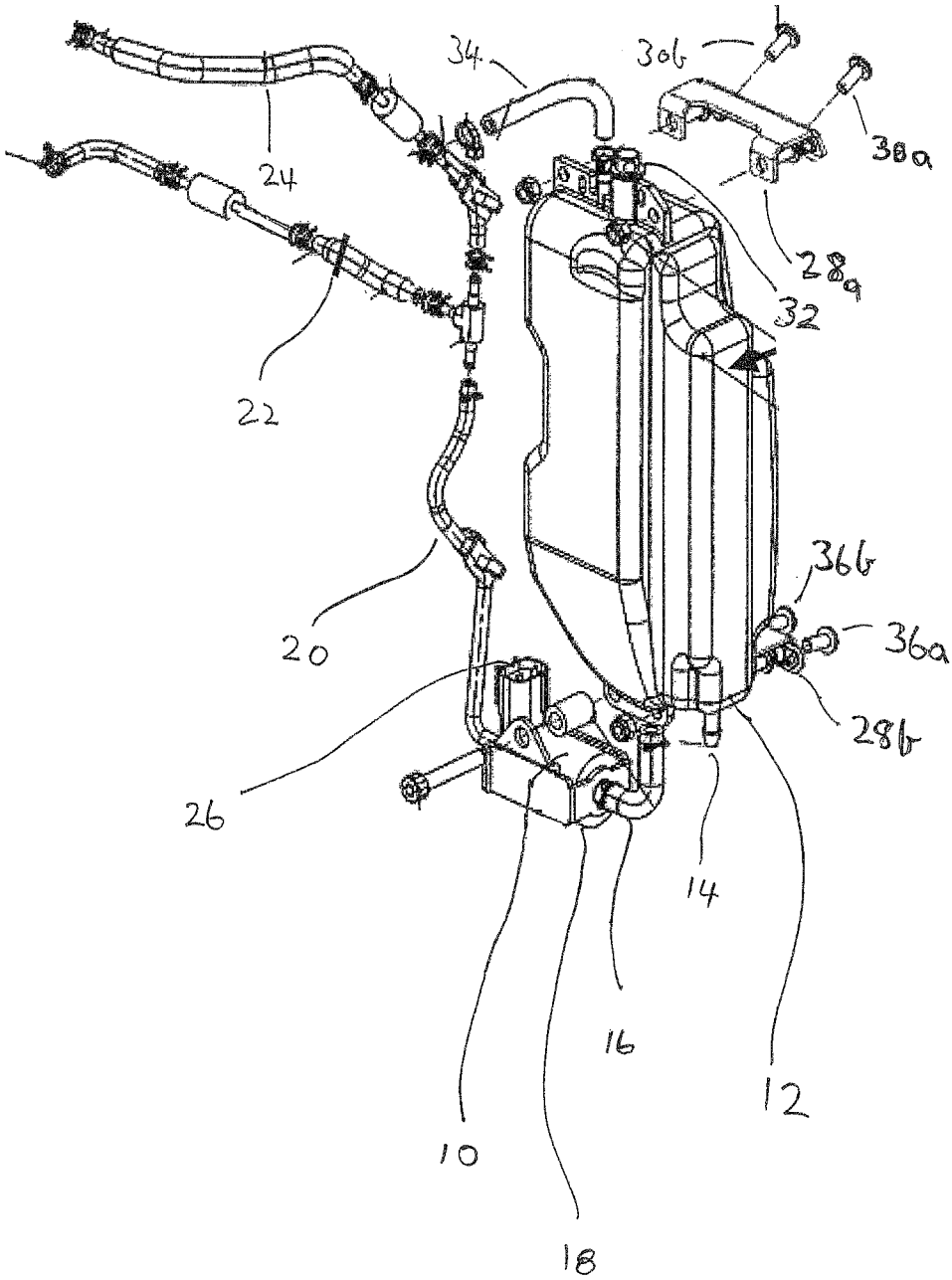
FIG. 1 shows a portion of an oil supply system for a UAV engine including an electric oil pump according to an embodiment of the present invention.

In FIG. 1 the inlet and outlet are shown disconnected. The pump is mounted adjacent the bottom of the reservoir bottle. The bottle is mounted to the UAV or UAV engine via a top and bottom bracket 28*a*, 28*b* arrangement and respective mounting fasteners 30*a*,30*b*, & 36*a*,36*b*. The reservoir includes a filler inlet 32 with associated filler pipe 34.

The pump includes an electric solenoid within a housing 18 of the pump. The pump includes an electrical connection 26 to a power supply and an ECU. The pump is controlled by the engine control unit (ECU).

The pump is a positive displacement device actuated by the solenoid. When the solenoid is activated a plunger within the pump moves one full stroke delivering a known volume of oil. The pump is plumbed to discrete locations on the engine in order to directly deliver oil via conduits 20, 22, 24 to the desired locations in the crankcase, cylinder wall and air compressor. Oil delivery to the cylinder wall allows the special oil formulation to clean carbon build up from around the piston ring, in addition to providing lubrication to the piston. Oil delivery to the crankcase and air compressor allows lubrication of the bearing elements of the engine and compressor respectively.

Locating the pump below the storage bottle makes for good priming of the oil circuit and reduces or prevents air bubbles forming and restricting oil flow. The storage bottle may be opaque or transparent to allow the operator to assess the level of oil remaining. The storage bottle can have volume indicator markings on it to assist in assessing the volume of oil it contains.

Strategies for controlling the oil pump applicable to the UAV engine include:

- Accumulating (integrating) the required oil delivery amount with time based upon a desired fuel-oil ratio, preferably mapped against engine speed and engine load.
- Modifying the oil delivery for engine load transients.
- Providing additional oiling at engine start to replenish what may have drained away while the engine was turned off.
- Controlling oil pump actuation (solenoid turn on and turn off times).
- Facilitating engine running-in (break-in) through elevated oil delivery for first hours of operation following engine assembly or re-build. This replaces the typical practice of operating with higher oil to fuel ratios in pre-mix fuel. Engine break-in time is initiated at end of production line, or via user input to the ECU (diagnostic tool or other).

Elevated rate of oil delivery can also be used at start up when assisting engine warm up and early lubrication.

Furthermore, improved control of the UAV engine is also proposed, as follows:

- Maintaining engine speed dependent minimum oil delivery rates. This is necessary due to the high altitudes that a UAV engine may operate at. As altitude increases, the fuel required to achieve a given speed drops due to unloading of the propeller due to reducing air density. If the pre-mix fuel-oil flow rate calculation uses a fuelling or fuel to oil ratio dependency, the oil delivered to the engine will decrease with altitude. This has been found to lead to oil starvation and engine damage. Consequently, engine speed dependent minimum oil delivery rates addresses this problem.
- Heating of the electric oil pump and oil through extended ON time of the solenoid. This is used when required oil flow is low enough for there to be an OFF time longer than the minimum OFF time required for the piston to return to its seat and the pump to re-fill with oil. This extended on time causes the pump coil to energise for longer than it takes for the pump stroke, and thereby allows the coil to heat up. This helps to heat the pump and oil.
- Varying the turn on time of the electronic oil pump based on sensed ambient temperature such that long times are used to ensure oil delivery for cold temperatures, and shorter times are permitted when necessary in order to reach maximum oil flow rate. This allows the oil pump to make its best attempt at oil delivery at high flow rates, while ensuring that the pump has the best chance to deliver high viscosity oil (such as when cold) at lower flow rates. It has been found that cold oil (high viscosity) provides sufficient restriction to slow the solenoid plunger during the delivery stroke.

Figure 2:
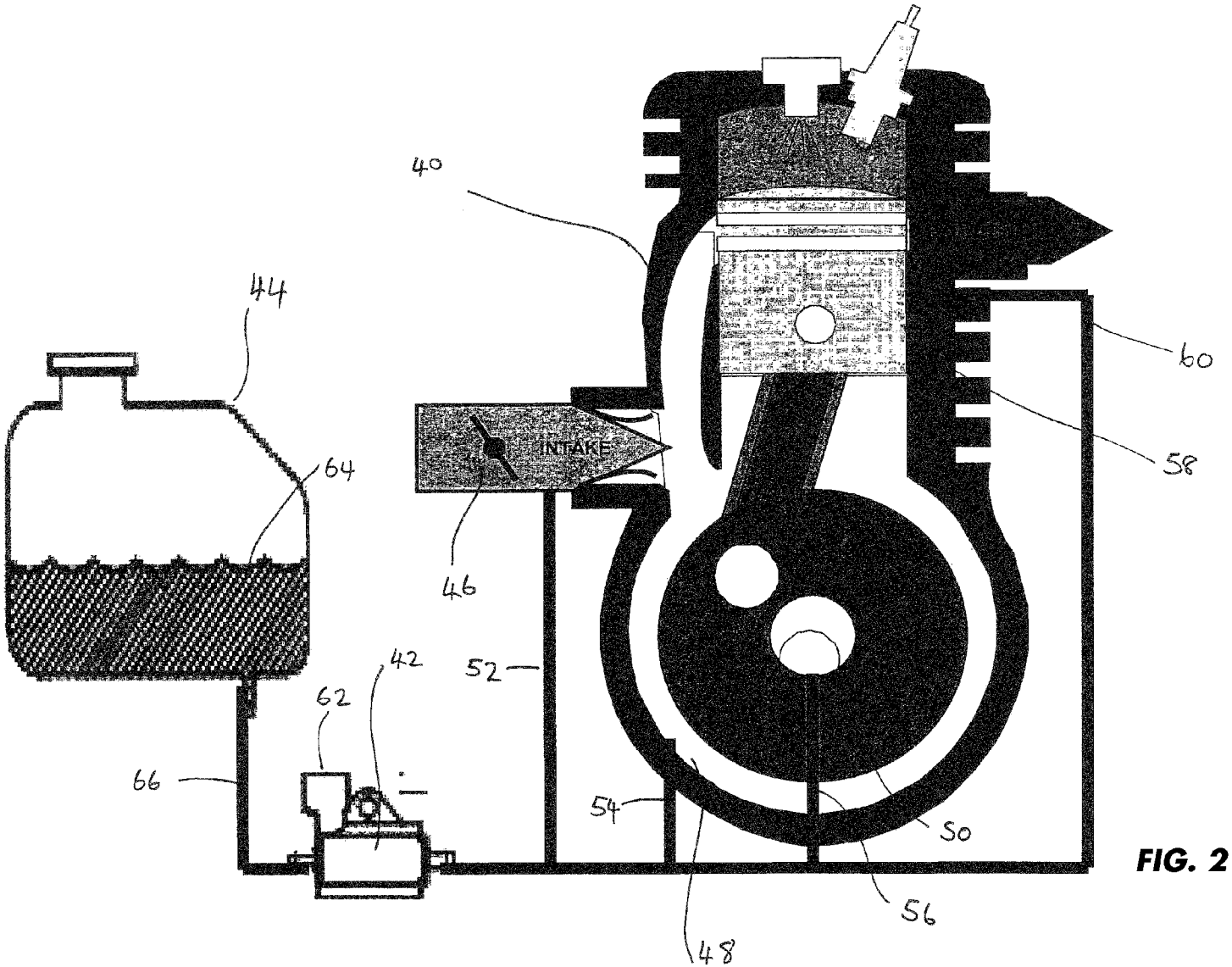
FIG. 2 shows a schematic depicting an electric fuel pump supply of oil from a reservoir to a UAV engine.

As shown in FIG. 2, a UAV engine 40 receives lubrication oil from an electric oil pump 42. Oil is supplied to the electric pump from an oil reservoir or tank 44. Oil is supplied from the pump to an intake 46 of the engine, a crankcase 48 and crankshaft journals and bearings 50 via respective supply conduits 52, 54, 56, as well as to the cylinder 58 via a further conduit 60. An electric supply and control connection 62 is provided to power and control the pump. The pump delivers oil 64 from the reservoir or tank (supplied via conduit 66) to the engine.

Figure 3:
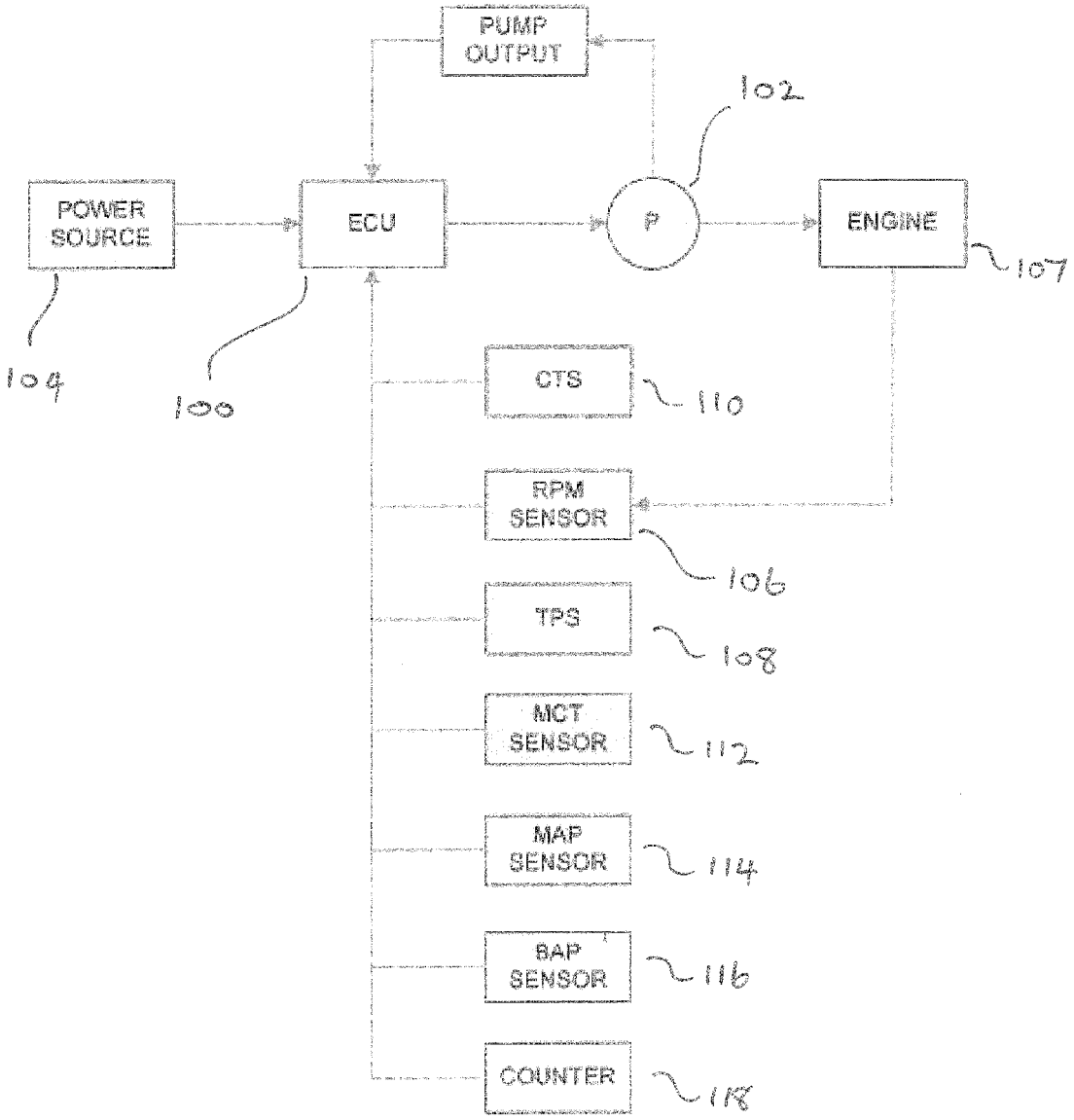
FIG. 3 shows an overall flow chart of an electric oil pump control strategy to effect heating of lubrication oil, including various sensor inputs, according to an embodiment of the present invention.

According to a preferred embodiment referenced to FIG. 3, an ECU 100 (e.g. an electrical controller) is electrically connected to the electronic oil pump 102 to supply current to the solenoid coil associated with the pump. The ECU is connected to a power source 104 and, based on inputs from one or more sensors described below, regulates when current from the power source is applied to the solenoid coil to deliver the required amount of lubricant to the engine 107.

An engine speed sensor 106 is connected to the engine 107 and is electrically connected to the ECU to provide a signal indicative of engine speed to the ECU.

The engine has a toothed wheel (not shown) disposed on and rotating with the crank shaft of the engine. The engine speed sensor is located in proximity to the toothed wheel and sends a signal to the ECU representative of the relative distance between the engine speed sensor and the toothed wheel. The ECU then analyses the signal to detect the passing of each tooth. The ECU determines the engine rotation speed by calculating the time elapsed between the passing of each tooth.

A throttle position sensor (TPS) 108 is disposed adjacent a throttle body of the engine and is electrically connected to the ECU to provide a signal indicative of the position of the throttle plate inside the throttle body.

A coolant temperature sensor (CTS) 110 is disposed in the cooling system of the engine adjacent the cylinder head exposed to the water jacket and is electrically connected to the ECU to provide a signal indicative of the temperature of the coolant to the ECU.

A manifold charge temperature sensor (MCT sensor) 112 is disposed between the throttle body and the reeds exposed to the air mass induced into the engine and is electrically connected to the ECU to provide a signal indicative of the temperature of the air mass to the ECU.

A manifold absolute pressure sensor (MAP sensor) 114 is disposed between the throttle body and the reeds exposed to the air mass induced into the engine and is electrically connected to the ECU to provide a signal indicative of the pressure of the air mass to the ECU.

A barometric absolute pressure sensor (BAP sensor) 116 is disposed in the air box and is electrically connected to the ECU to provide a signal indicative of the ambient air pressure to the ECU. Depending on the type of engine and the operating range this functionality could be provided by the MAP sensor.

A counter 118 is electrically connected to the ECU. The counter includes a timer and provides a signal indicative of time to the ECU.

The electronic oil pump has an inherent 'Time Delay' that is determined by an elapsed time from the time an electric current it received by the electronic oil pump from the ECU to the time that lubricant is actually initially expelled from the electronic oil pump during a pumping stroke. This time delay can vary from one pump to another due to manufacturing tolerances, and compensation can be provided within the control strategy to adjust for this time delay tolerance of the electronic oil pump.

Preferably, the energisation time ('ON' time) of the oil pump solenoid is calibrated to be longer than the worst case Time Delay. Due to manufacturing tolerances the amount of lubrication delivered per stroke of the electronic oil pump varies from part to part. Time compensation can be provided by the control strategy for the delivery tolerance of the electronic oil pump. However, in an 'uncompensated' control strategy of the present, the control strategy assumes that for all ambient temperatures and pressures each electronic oil pump will deliver the same quantity lubricant per complete stroke.

Figure 4:
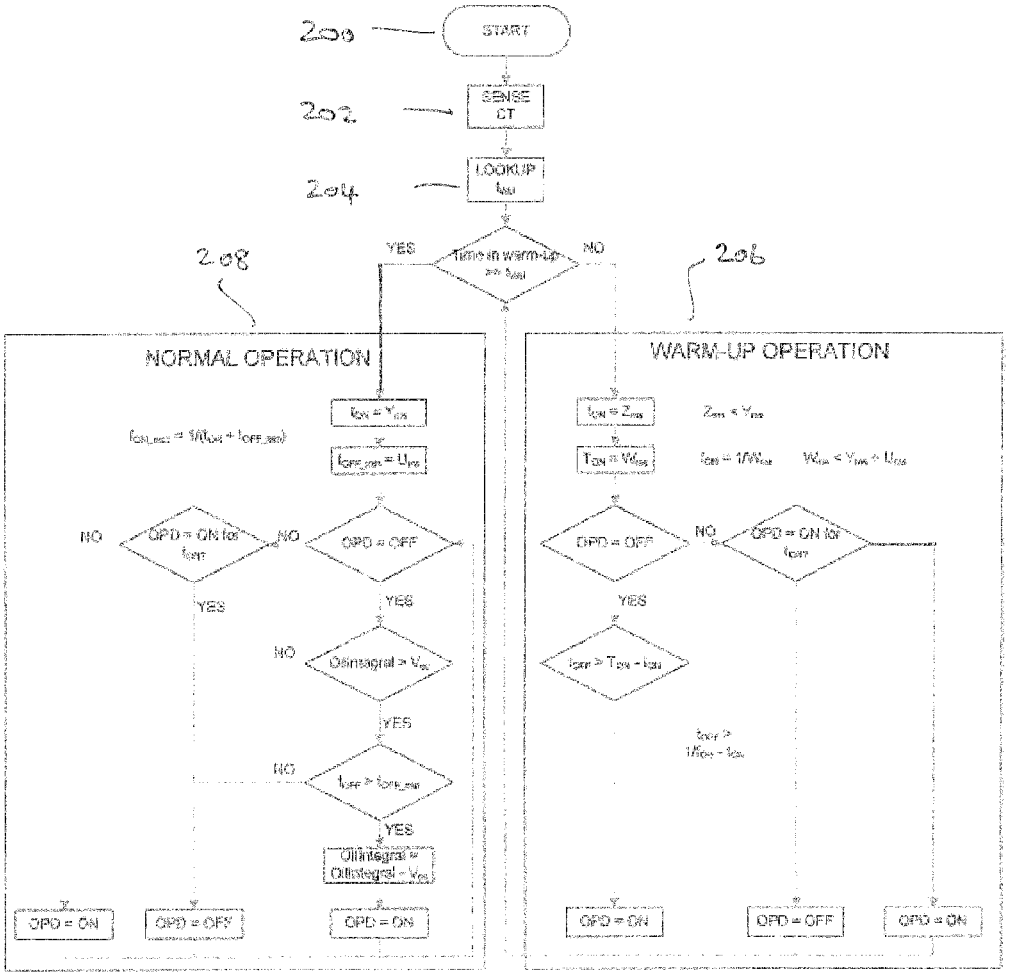
FIG. 4 shows a more detailed flow chart compared to FIG. 3, with electric oil pump control strategies given warm-up and normal operation options, according to an embodiment of the present invention.

According to an embodiment of the present invention referenced to FIG. 4, a method of controlling the electronic oil pump commences once the engine is started 200. Coolant temperature (CT) is sensed 202 by the CTS which sends a signal representative of the temperature to the ECU. The ECU uses the temperature sensed to lookup the required warm-up time ($t_w$) 204. The required warm-up time represents the time to be spent in the 'warm-up routine' following an engine start with a coolant temperature of CT.

An ECU counter counts the time since engine start. During the Warm-up routine 206, the electric oil pump is actuated (OPD=ON) with a turn on time ($t_{ON}$) shorter than the time it takes the pistons to move from their rest position to the maximum position, known as the stoke time ($ts_{TROKE}$). This is because the lubricant present in the electronic oil pump needs to be heated in order to reduce its viscosity and facilitate pumping thereof.

By applying current to the coil for a shorter period of time ($t_{ON}=Z_{ms}$) than would normally be used ($t_{ON}=Y_{in}$) the solenoid coil generates heat while delivering a minimal amount of oil. Because the turn on time is shorter than the time to stroke the electronic oil pump the driver is activated (OPD=ON) with a cycle time ($T_{ON}$) of W. The value of W is less than the minimum cycle time enforced during 'normal operation' which is equal to the sum of Y and U. The cycle time W corresponds to a cycle frequency ($t_{ON}$) of 1/W which is higher than the maximum driver frequency ($t_{ON_max}=1/(Y+U)$) enforced in 'normal operation'.

The shorter cycle time (and hence higher frequency) during the 'warm-up routine' results in more cycles per unit time and hence increases the electrical power applied to the solenoid being converted to heat. The warm-up routine is ended once the ECU count of the time since engine start exceeds the warm up time $t_{wu}$. 'Normal operation' 208 is then commenced.

During 'normal operation' 208 the electric oil pump is actuated with a turn on time ($t_{ON}$) of Y. The value Y is greater than $t_{STROKE}$. The oil pump is actuated when the desired volume of oil yet to be delivered (OilIntegral) is greater than V on the condition that the time for which current has not been applied to the electromagnetic coil ($t_{OFF}$) is greater than the minimum off time ($t_{OFF_min}$) which has a value of U. U represents the time required between oil pump actuation events for the oil pump piston to return to the rest position (tRET) and for the oil volume in the pump to be replenished. U is greater than $t_{RET}$. OilIntegral is reduced by the value V on each electronic oil pump actuation during 'normal operation'.

By way of the present invention, control of lubrication oil supply for increased range and duration of UAVs is able to be improved, particularly for 2 stroke UAV engines utilising direct injection. Furthermore, controlled operation of an electric solenoid actuated lubrication oil pump when applied to such UAV engines can serve to provide additional heat to the lubrication oil at start-up, and during engine running, which is particularly beneficial for UAV engines required to endure high altitude or long duration running in cold climates.

The invention claimed is:

1. An unmanned aerial vehicle (UAV) engine lubrication system including a solenoid actuated electric oil pump to deliver lubrication oil to the engine from a lubrication oil reservoir by energising and de-energising the solenoid to operate a pump mechanism of the electric oil pump, and a controller to control operation of the electric oil pump, the solenoid maintained energised for a first period of time during an engine warm up routine, the first period of time being shorter than a stroke time of the pump, and the solenoid maintained energised for a second period of time during normal operation of the engine the second period of time being longer than the stroke time of the pump, to cause heating of the oil without continuously pumping the oil.

2. A system according to claim 1, the controller including an electronic control unit (ECU) electrically connected to the electric oil pump for controlling actuation of the electric oil pump.

3. A system according to claim 1, including an engine speed sensor electrically connected to the ECU for transmitting a signal representative of engine speed to the ECU.

4. A system according to claim 3, the ECU arranged to control actuation of the electric oil pump based at least in part on a signal representative of engine speed.

5. A system according to claim 1, further including at least one temperature sensor, and the solenoid energization period is determined at least in part by sensed temperature.

6. A system according to claim 1, wherein the electric oil pump is external to or within an oil supply reservoir for the engine.

7. A system according to claim 6, the electric oil pump connected to a bottom of the oil reservoir to receive an oil feed from an outlet adjacent or at a bottom of the reservoir.

8. A system according to claim 1, the system provided on a UAV engine having a single fluid or a dual fluid direct injection system.

9. A system according to claim 8, the direct injection system arranged to inject heavy fuel to one or more combustion chambers of the engine.

10. A system according to claim 1, the system including at least one heat generating component arranged to warm the pump and oil pumped by the pump.

11. A system according to claim 10, the at least one heat generating component including at least one of: an exhaust conduit fluidly communicating with an exhaust port of the engine; a coolant hose fluidly communicating with a cooling system of the engine; and a heat exchanger fluidly communicating with a cooling system of the engine.

12. A method of pre-heating lubrication oil for supply to an engine of an unmanned aerial vehicle (UAV), the method including energising a solenoid associated with an electric oil pump with an electrical current for a first period of time during an engine warm-up routine, the first period of time being shorter than a stroke time of the pump, and the solenoid maintained energised for a second period of time during normal operation of the engine the second period of time being longer than the stroke time of the pump, to cause heating of the oil without continuously pumping the oil.

13. A method according to claim 12, including operating the pump for a shorter cycle time and higher frequency during the warm-up routine for more pump cycles per unit time than for normal pump operation after the warm-up routine.

14. A method according to claim 12, whereby the first or second period that the solenoid is energised is varied dependent upon engine speed or temperature, or both engine speed and temperature.

15. A method according to claim 12, whereby the energised second period extends a duty energised period of the solenoid during a pumping stroke of the pump.

16. A method according to claim 12, including effecting control of the solenoid for warm-up (pre-heating) or normal duty cycle, or both warm-up (pre-heating) and normal duty cycle via an ECU.

17. A method according to claim 16, including ending the warm-up routine when a count by an ECU of the time since engine start exceeds a warm-up time.

18. A method of operating an electric oil pump of an oil lubrication system of a direct injection UAV engine, the pump including a solenoid, the method including determining a cycle time of the electronic oil pump; determining a first time period during an engine warm-up routine being shorter than a stroke time of the pump; connecting the solenoid to an electrical supply for the first time period; and disconnecting the solenoid from the electrical supply or reducing the electrical supply to de-energise the solenoid for a remainder of the cycle time, and the solenoid maintained energised for a second period of time during normal operation of the engine, the second period of time being longer than the stroke time of the pump, to cause heating of the oil without continuously pumping the oil.

19. A method according to claim 18, whereby the first time period is less than or equal to the pump cycle time less a return time of the electronic oil pump's solenoid.

20. A method according to claim 18, including connecting an electromagnetic coil of the pump to an electrical power source for the first time period to cause the coil to heat thereby warm a lubricant oil to be pumped by the electric oil pump.

21. A method according to claim 20, including using a measure of air temperature as an input to the control of warming.

22. A method according to claim 18, further including sensing an engine speed of an engine and controlling the electric pump based on that sensed engine speed.

23. A method according to claim 18, including counting number of actuations of the electric pump via an electronic engine control unit (ECU) and using the count to report and record accumulated oil consumption and/or oil volume remaining in the oil reservoir.

* * * * *